US011021298B2

(12) United States Patent
Williams

(10) Patent No.: US 11,021,298 B2
(45) Date of Patent: Jun. 1, 2021

(54) ORGANIZATION AND STORAGE DEVICE

(71) Applicant: Jason Williams, Fernley, NV (US)

(72) Inventor: Jason Williams, Fernley, NV (US)

( * ) Notice: Subject to any disclaimer, the term of this patent is extended or adjusted under 35 U.S.C. 154(b) by 0 days.

(21) Appl. No.: 16/865,667

(22) Filed: May 4, 2020

(65) Prior Publication Data

US 2021/0122527 A1 Apr. 29, 2021

Related U.S. Application Data

(60) Provisional application No. 62/924,757, filed on Oct. 23, 2019.

(51) Int. Cl.

| | |
|---|---|
| ***B65D 25/04*** | (2006.01) |
| ***B65D 81/38*** | (2006.01) |
| ***B65D 47/06*** | (2006.01) |
| ***B65D 43/02*** | (2006.01) |
| ***B25H 3/00*** | (2006.01) |
| ***B65D 25/20*** | (2006.01) |
| ***A45C 11/20*** | (2006.01) |
| ***A45C 13/02*** | (2006.01) |
| ***B65D 25/28*** | (2006.01) |

(52) U.S. Cl.

CPC ..... *B65D 25/04* (2013.01); *A45C 11/20* (2013.01); *A45C 13/02* (2013.01); *B25H 3/00* (2013.01); *B65D 25/20* (2013.01); *B65D 25/2841* (2013.01); *B65D 43/0225* (2013.01); *B65D 47/06* (2013.01); *B65D 81/3813* (2013.01)

(58) Field of Classification Search

CPC ..... A45C 11/20; A45C 13/02; B25H 3/00; B65D 25/04; B65D 25/20; B65D 25/28; B65D 25/2841; B65D 43/02; B65D 43/0225; B65D 47/06; B65D 81/38; B65D 81/3813; F25D 3/08; F25D 3/00; A45F 5/02; A45F 5/021

USPC ..... 206/541–549; 62/457.1, 457.7; 224/148.5, 148.6

See application file for complete search history.

(56) References Cited

U.S. PATENT DOCUMENTS 2,954,893 A * 10/1960 Sayre ..... A47J 41/0088 206/545
3,120,404 A 2/1964 Carl
3,751,845 A * 8/1973 van Leeuwen ..... A01K 97/06 206/542

(Continued)

FOREIGN PATENT DOCUMENTS

KR 2009007253 U * 7/2009 ..... B65D 25/04

*Primary Examiner* — Bryon P Gehman
(74) *Attorney, Agent, or Firm* — Boudwin Intellectual Property; Daniel Boudwin

(57) ABSTRACT

An organization and storage device has a housing including a base with at least one sidewall extending therefrom, thereby defining an interior volume and an open end. The housing is divided into a series of compartments by dividers. A first compartment can store a liquid, such as ice water, and is in operable connection with a spout disposed on the sidewall. A tray is removably disposed above the first compartment. A cover can be removably secured to the open end of the housing and a drawer is disposed proximal to the base. In some embodiments, a toolbelt channel is disposed along a circumference of the sidewall, that can be utilized to secure a toolbelt with tools. The device can support an individual in a seated position and can be utilized to transport a variety of necessary items to and from a work site.

19 Claims, 3 Drawing Sheets

(56) References Cited

U.S. PATENT DOCUMENTS

| | | | | | |
|---|---|---|---|---|---|
| 4,974,426 | A * | 12/1990 | Gomez | F25D 3/08 | 62/457.7 |
| 5,086,926 | A * | 2/1992 | Paige | A47J 41/02 | 206/542 |
| 5,329,787 | A * | 7/1994 | Friday | F25D 3/08 | 62/457.7 |
| 5,366,089 | A * | 11/1994 | Parker | A45C 11/20 | 206/546 |
| 5,462,213 | A * | 10/1995 | Watt | A45C 15/00 | 224/629 |
| 5,979,175 | A * | 11/1999 | Ellison | A45C 15/00 | 62/457.7 |
| 6,000,752 | A | 12/1999 | Shyr | | |
| 6,341,817 | B1 | 1/2002 | Stern-Gonzalez | | |
| 6,357,252 | B1 * | 3/2002 | Rand | A45C 11/20 | 62/457.2 |
| 6,474,097 | B2 | 11/2002 | Treppedi et al. | | |
| 8,695,372 | B1 * | 4/2014 | Dyal | F25D 3/08 | 62/457.4 |
| 10,760,847 | B2 * | 9/2020 | Goodloe | F25D 3/08 | |
| 2005/0274726 | A1 | 12/2005 | Boggs et al. | | |
| 2008/0245095 | A1 * | 10/2008 | Schlipman | F25D 3/08 | 62/457.1 |
| 2010/0212351 | A1 * | 8/2010 | Chapin | F25D 3/08 | 62/457.5 |
| 2010/0275642 | A1 * | 11/2010 | Klettner | A45C 11/20 | 62/457.7 |
| 2015/0107293 | A1 * | 4/2015 | Encinas | F25D 3/08 | 62/457.7 |

* cited by examiner

ORGANIZATION AND STORAGE DEVICE

CROSS REFERENCE TO RELATED APPLICATIONS

This application claims the benefit of U.S. Provisional Application No. 62/924,757 filed on Oct. 23, 2019. The above identified patent application is herein incorporated by reference in its entirety to provide continuity of disclosure.

BACKGROUND OF THE INVENTION

The present invention relates to portable storage devices. More particularly, the present invention provides for a portable organization and storage device that can be utilized to transport food, drink, tools, and other necessary personal items to and from a worksite while also providing a space on which an individual can sit and rest.

Many individuals, when venturing from the house, carry a wide assortment of personal items as well as food and drink with them. For example, construction workers typically carry a lunch box, a thermos, a tool belt, a large variety of tools, a cellphone, keys, and various other personal items to and from the jobsite. Similarly, outdoorsmen and women may venture out on a fishing or camping trip, or the like, and desire to bring certain personal items, food, and drink with them. Organizing and carrying such an eclectic assortment of items may be difficult and cumbersome. Forgetting one or more items may result in a missed meal, dehydration, or the individual lacking a necessary tool for the job. Additionally, once the individual is at their intended destination, or a point along the way, there may not be a comfortable spot to sit and rest.

Devices have been disclosed in the known art that relate to portable storage devices. These include devices that have been patented and disclosed in patent application publications. However, the devices in the known art have several drawbacks. Some portable coolers lack additional storage space and can be immensely bulky and cumbersome to transport. Additionally, such coolers typically do not provide a comfortable surface on which an individual can rest. Relatedly, these coolers are also not constructed to support an individual's weight over a prolonged period of time. The present invention substantially diverges in design elements from the known art and consequently it is clear that there is a need in the art for an improvement to existing portable storage devices. In this regard the present invention substantially fulfills these needs.

SUMMARY OF THE INVENTION

In view of the foregoing disadvantages inherent in the known types of portable storage devices now present in the prior art, the present invention provides for a portable organization and storage device that can be utilized to transport food, drink, tools, and other necessary personal items to and from a worksite while also providing a space on which an individual can sit and rest. The present organization and storage device comprises a housing including a base with at least one sidewall extending therefrom, thereby defining an interior volume and an open end. The housing is divided into a series of compartments by dividers. A first compartment can store a liquid, such as ice water, and is in operable connection with a spout disposed on the sidewall. A tray is removably disposed above the first compartment. A cover can be removably secured to the open end of the housing and a drawer is disposed proximal to the base. In some embodiments, a toolbelt channel is disposed along a circumference of the sidewall, that can be utilized to secure a toolbelt with tools. The device can support an individual in a seated position and can be utilized to transport a variety of necessary items to and from a work site.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
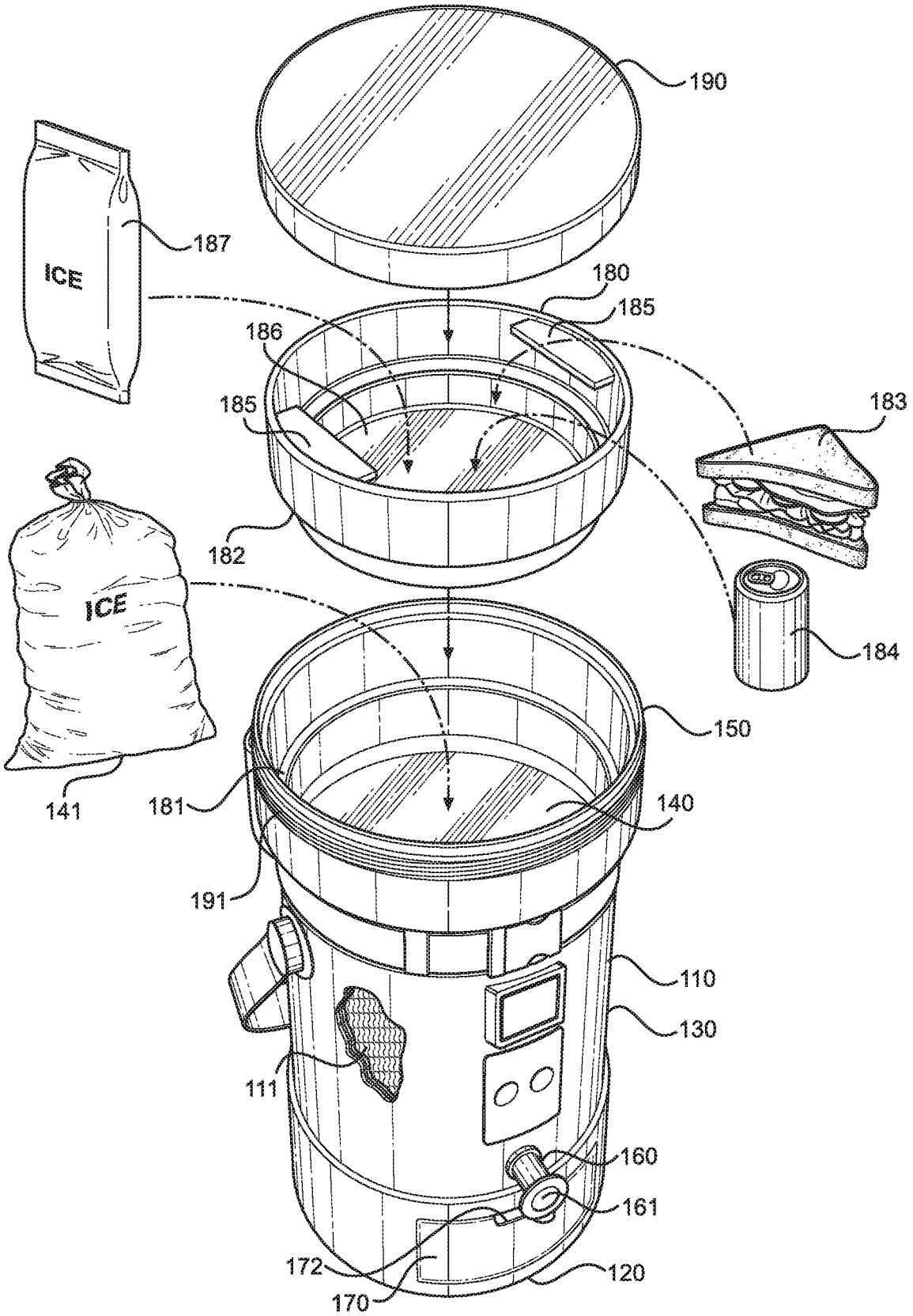
FIG. 1 shows an exploded view of an embodiment of the organization and storage device.

Reference is made herein to the attached drawings. Like reference numerals are used throughout the drawings to depict like or similar elements of the organization and storage device. For the purposes of presenting a brief and clear description of the present invention, a preferred embodiment will be discussed as used for the organization and storage device. The figures are intended for representative purposes only and should not be considered to be limiting in any respect.

Referring now to FIG. 1, there is shown an exploded view of an embodiment of the organization and storage device. The organization and storage device comprises a housing 110 including a base 120 with at least one sidewall 130 extending upwardly therefrom, thereby defining an interior volume 140 and an open end 150. In the shown embodiment, the housing 110 is cylindrical with a radius and size analogous to a five-gallon bucket. The housing 110 is comprised of durable materials that are able to withstand impacts as well as wear associated with rough environments such as a work site. The housing 110 comprises an insulating material 111 that is configured to form a thermal barrier between the interior volume 140 and the outside of the device. One of ordinary skill in the art will understand how the insulating material 111 will enable the device to keep personal items and fluids stored therein within a temperature range independent of the temperature outside the device.

The interior volume 140 is configured to store a liquid therein. One of ordinary skill in the art will understand that the housing 110 includes liquid-tight seals such that the liquid stored within the interior volume 140 will be contained therein and not leak or spill outside the device. The interior volume 140 is also in fluid communication with a spout 160 disposed on the sidewall 130. In the shown embodiment, the spout 160 further comprises a push-button 161, wherein actuation of the push-button 161 enables the fluid stored in the interior volume 140 to travel through the spout 160 to the exterior of the device. In this manner, a user can store a desired fluid, such as water, mixed with ice 141 in the interior volume 140 and dispense the ice water via actuation of the push-button 161, resulting in the flow of the ice water into a cup or other desired container positioned underneath the spout 160. In one embodiment, a plurality of ventilation holes are disposed through an external surface of the at least one sidewall 130 that allow the fluid stored in the interior volume 140 to flow properly when the spout 160 is utilized.

Figure 2:
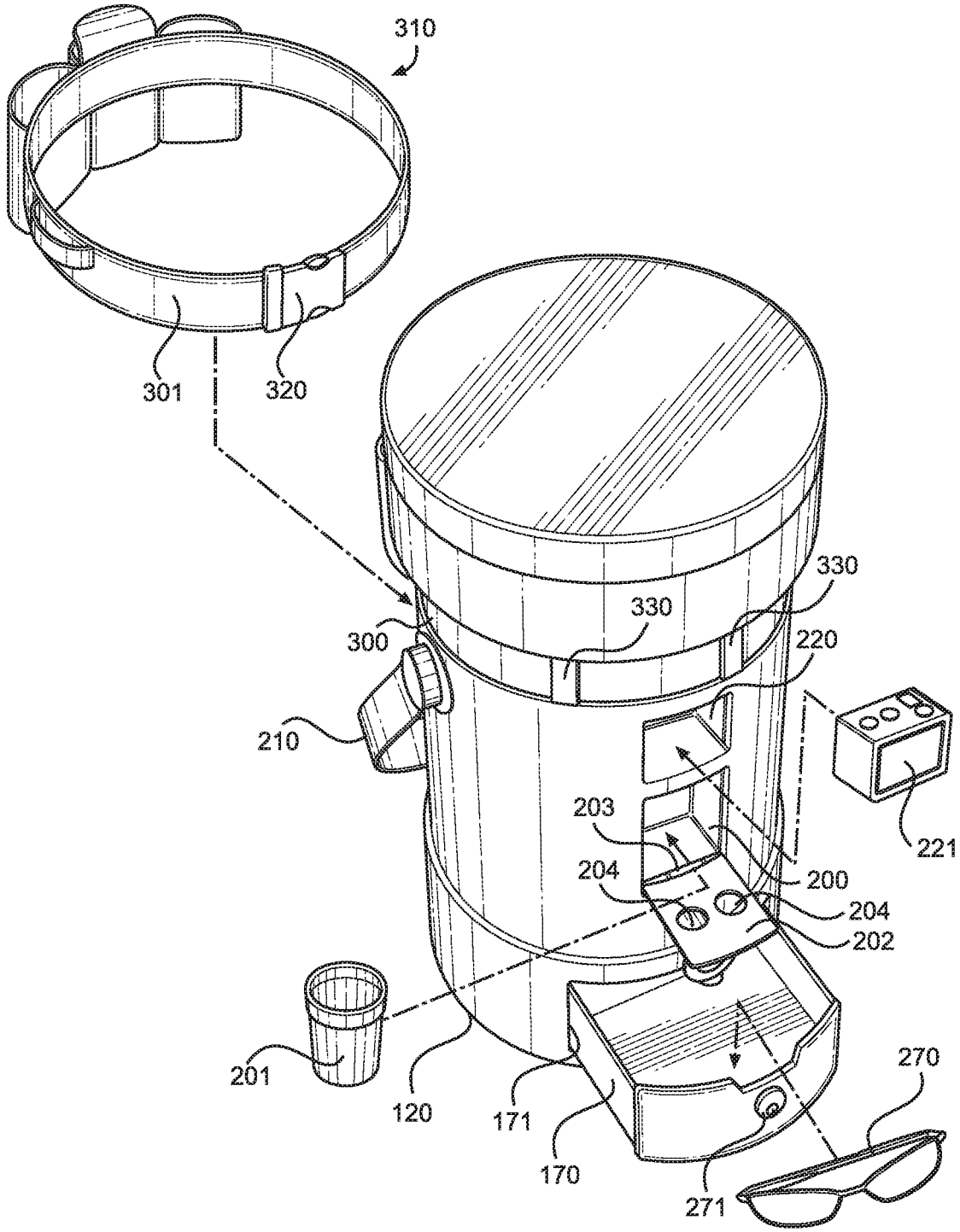
FIG. 2 shows a front perspective view of an embodiment of the organization and storage device.

A drawer 170 is disposed proximal to the base 120. In one embodiment, the drawer 170 is slidably received in a drawer channel (as shown in FIG. 2, 171) disposed in the base 120. In the shown embodiment, the spout 160 is disposed above a drawer 170 such that when the drawer 170 slides out of the drawer channel, the drawer 170 does not come into contact with the spout 160. In the shown embodiment, the drawer 170 further includes a notch 172 that can be utilized to pull the drawer 170 open and that further enables the drawer 170 to slide out without coming into contact with the spout 160.

A tray 180 is removably disposed within the interior volume 140. In one embodiment, the sidewall 130 includes a perimeter shelf 181 that is configured to receive a lip portion 182 of the tray 180. In such a manner, the tray 180 can rest on the perimeter shelf 181 and be held within a top portion of the interior volume 140, and can be held in a position such that the tray 180 does not fall into, or be submersed in, the liquid stored therein. The tray 180, in this manner, provides a dry area within the device in which food 183 and drinks 184 can be stored. In the shown embodiment, the tray 180 further includes a pair of internal handles 185 which can be utilized to remove and replace the tray 180 within the interior volume 140. In one embodiment, the tray 180 includes a depression 186 which is configured to receive an ice pack 187 or a heating pack.

A cover 190 is removably secured to the open end 150 of the housing 110. In one embodiment, the cover 190 is threadably secured to a complimentary threading 191 on the open end 150 of the housing 110. Such a mating of threaded surfaces enables the cover 190 to be held on securely to the housing 110, thereby preventing the cover 190 from falling off. In an alternate embodiment, the cover 190 is frictionally secured to the open end 150 of the housing 110. In one embodiment, the cover 190 is configured to support the weight of a person. The cover 190, when secured to the housing 110, can function as a seat such that a person can sit on the device and rest. The cover 190 and the housing 110 are constructed of durable materials that can withstand the weight and stresses associated with a person resting thereon. In one embodiment, the cover 190 comprises a padded material. Such a padded material provides a comfortable surface on which a person can rest while seated.

Referring now to FIG. 2, there is shown a front perspective view of an embodiment of the organization and storage device. In some embodiments, the housing further comprises a cup recession 200 disposed in at least one sidewall. The cup recession 200 is sized to receive a drinking container 201 such as an 8-ounce, 12-ounce, or 16-ounce drinking cup. In other embodiments, various other size drinking cups, and related drinking containers 201 can be received therein. In further embodiments, a cup holder 202 is pivotally secured to the sidewall via a hinge 203 disposed on the sidewall 130. The cup holder 202 is configured to cover the cup recession 200 when oriented in a closed position and can support the weight of a full drinking container 201 in an open position. In the shown embodiment, a pair of fingerholes 204 are disposed through the cup holder 202 which can be utilized to move the cup holder 202 between the open and closed positions.

In the shown embodiment, a handle 210 is disposed on the at least one sidewall. One of ordinary skill in the art will understand how the handle 210 can be utilized to carry the device and that the handle is of sufficient strength and durability to carry a full load without breaking. In the shown embodiment, the handle 210 is hingedly disposed on the at least one sidewall at opposing faces of the sidewall. Such a configuration enables the handle 210 to fold down and rest against the sidewall when not in use and enables a user to rotate the handle 210 into an upright position which can aid the user in carrying the device.

In some embodiments, a speaker recession 220 is disposed in the sidewall. Similar to the cup recession 200, the speaker recession 220 can receive a portable speaker 221 therein. In a further embodiment, the speaker recession 220 can receive the portable speaker 221 such that when the portable speaker 221 is fully received therein, a front face of the speaker 221 can rest flush and continuously with the at least one sidewall. In such a manner, a user can secure the speaker 221 in the speaker recession 220 without any portion of the speaker 221 extending beyond the sidewall, thereby preventing accidental contact with the speaker 221.

As discussed previously, a drawer 170 is slidably received in a drawer channel 171 disposed in the base 120. The drawer 170 can be utilized to store personal items 270 such as sunglasses, cellphones, keys, and the like. In one embodiment, the drawer 170 includes a lock 271 that can be utilized to secure the drawer 170 in the base 120. In such a manner, a user can secure their personal items 270 in the drawer 170 and lock them away such that an unauthorized user is unable to access them. In one embodiment, a seal is formed when the drawer 170 is fully received inside the drawer channel 171. In a further embodiment, the seal is a waterproof seal. The seal can ensure that undesirable materials, such as mud and water, do not enter into the drawer 170 when the drawer is fully secured and received inside the drawer channel 171, thereby preventing such materials from contacting the personal items 270.

Figure 3:
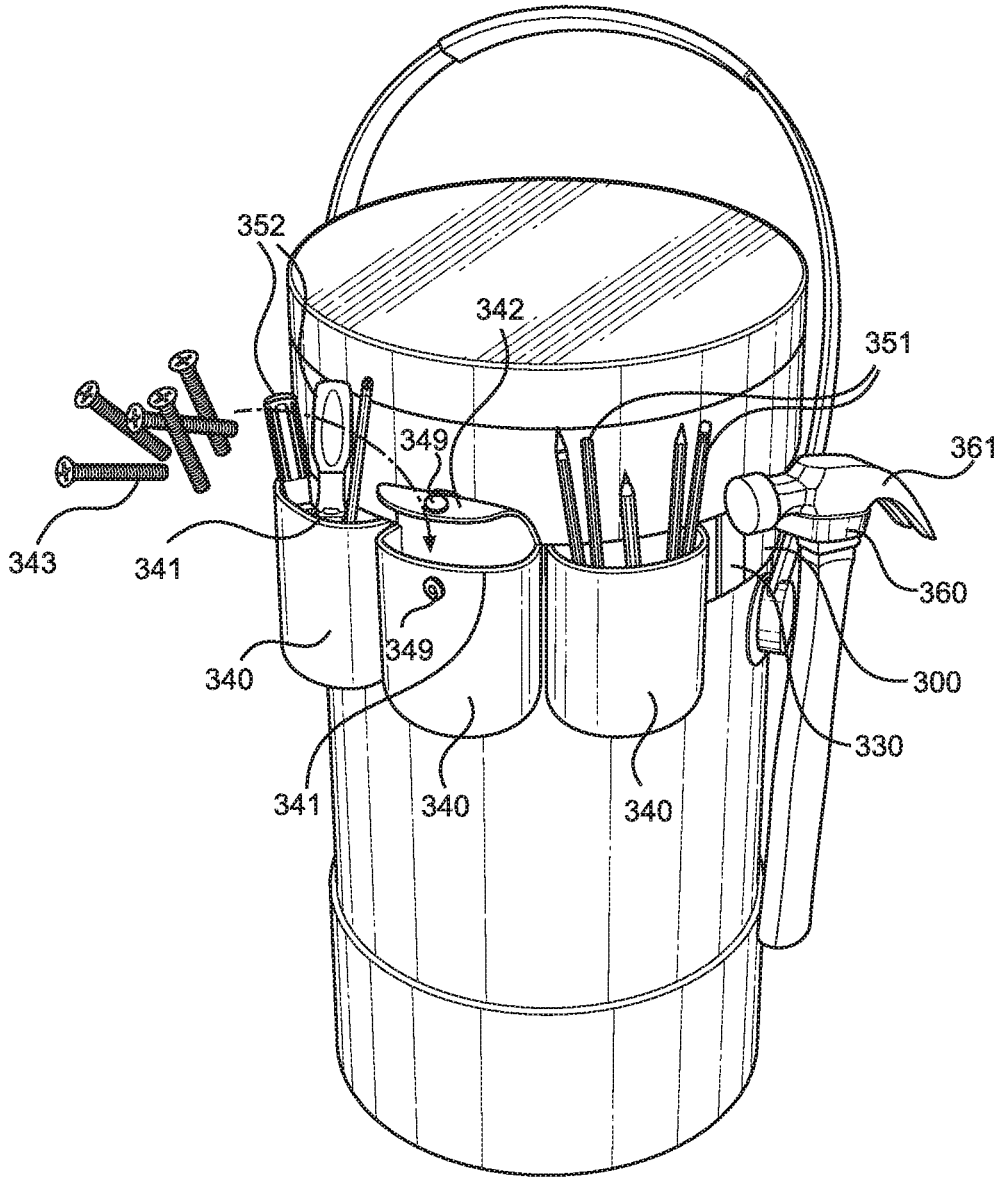
FIG. 3 shows a rear perspective view of an embodiment of the organization and storage device.

Referring now to FIGS. 2 and 3, there are shown a front perspective view of an embodiment of the organization and storage device and a rear perspective view of an embodiment of the organization and storage device. In one embodiment, a toolbelt channel 300 is disposed along a circumference of the at least one sidewall. The toolbelt channel 300 is configured to receive a toolbelt 310 therein. In one embodiment the toolbelt 310 is permanently secured within the toolbelt channel 300. In other embodiments, the toolbelt 310 is removably secured within the toolbelt channel 300. In such embodiments, a fastener 320 is disposed on opposing terminal ends of the toolbelt 310. One of ordinary skill in the art will understand that the fastener 320 can be a belt buckle or comprise complimentary male and female parts to secure together. In one embodiment, the toolbelt channel 300 further comprises a plurality of retaining members 330, wherein the retaining members 330 are configured to receive the toolbelt 310 thereunder. The retaining members 330 are sized to allow a band 301 of the toolbelt 310 to slide through and under the retaining members 330. The retaining members 330 help to ensure that the toolbelt 310 remains within the toolbelt channel 300 and does not slide or fall off of the device.

In various embodiments, the toolbelt 310 comprises a plurality of pockets 340. One of ordinary skill in the art will understand that in various embodiments, the toolbelt 310 may contain a variety of sizes, shapes, and number of pockets 340. Each pocket 340 may be utilized to store a desired item of the appropriate size. For example, one pocket 340 may be sized to store a large item such as a cellphone or tape measure, while another pocket 340 may be sized to store a small assortment of items such as nails or screws 343. In further embodiments, the pockets 340 can include an open end 341 thereby enabling a user to easily insert tools such as screwdrivers 352, marking devices such as pencils 351, and other personal items. In some embodiments, the pockets 340 can include a flap 342 that is sized to cover the open end 341. The flap 342 can include a flap closure 349 to enable the flap 342 to be held in a closed position, thereby providing an enclosed storage space for smaller items, such as screws 343. The flap 342 enables the smaller items to remain within an interior volume of the pocket 340 such that the items will not spill out unintentionally. In one embodiment, a loop 360 is disposed on the toolbelt 310. The loop 360 can be utilized, as shown in FIG. 3, to receive and store tools such as a hammer 361.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An organization and storage device, comprising:

a housing including a base with a sidewall extending upward therefrom, thereby defining an interior volume and an open end;

a toolbelt channel disposed along a circumference of the sidewall configured to receive a toolbelt;

the interior volume configured to store a liquid;

the interior volume in fluid communication with a spout disposed on the sidewall;

a tray removably disposed within the interior volume;

a cover removably secured to the open end of the housing; and a drawer disposed proximal to the base;

the base, the tray and the cover each being of a circular diameter;

wherein the tray is of a lesser diameter than the base;

wherein the cover is of a greater diameter than the open end.

2. The organization and storage device of claim 1, wherein the sidewall includes a perimeter shelf configured to receive a lip portion of the tray.

3. The organization and storage device of claim 1, wherein the tray includes a depression configured to receive an ice pack.

4. The organization and storage device of claim 1, wherein the cover is configured to support a weight of a person.

5. The organization and storage device of claim 4, wherein the cover comprises a padded material.

6. The organization and storage device of claim 1, wherein the cover is threadably secured to the open end of the housing.

7. The organization and storage device of claim 1, further comprising a cup recession disposed in the sidewall.

8. The organization and storage device of claim 7, further comprising a cup holder hingedly disposed on the sidewall, configured to cover the cup recession in a closed position, and support the weight of a full cup in an open position.

9. The organization and storage device of claim 1, wherein the drawer includes a lock.

10. The organization and storage device of claim 1, wherein the drawer is slidably received in a drawer channel disposed in the base.

11. The organization and storage device of claim 1, wherein a seal is formed when the drawer is fully received inside the drawer channel.

12. The organization and storage device of claim 1, wherein the housing comprises an insulating material.

13. The organization and storage device of claim 1, further comprising a handle hingedly disposed on the sidewall.

14. The organization and storage device of claim 1, further comprising a speaker recession disposed in the sidewall.

15. The organization and storage device of claim 1, wherein the spout further comprises a push-button, wherein actuation of the push-button enables fluid stored in the interior volume to travel through the spout.

16. An organization and storage device, comprising:

a housing including a base with a sidewall extending upward therefrom, thereby defining an interior volume and an open end;

a toolbelt channel disposed along a circumference of the sidewall configured to receive a toolbelt;

the interior volume configured to store a liquid;

the interior volume in fluid communication with a spout disposed on the sidewall;

a tray removably disposed within the interior volume;

a cover removably secured to the open end of the housing; and a drawer disposed proximal to the base.

17. The organization and storage device of claim 16, wherein the toolbelt is removably secured within the toolbelt channel.

18. The organization and storage device of claim 17, wherein the toolbelt comprises a plurality of pockets.

19. The organization and storage device of claim 17, wherein the toolbelt channel further comprises a plurality of retaining members configured to receive the toolbelt thereunder.

* * * * *